US008072306B2

(12) United States Patent
Sugiyama et al.

(10) Patent No.: US 8,072,306 B2
(45) Date of Patent: Dec. 6, 2011

(54) ELECTRONIC COMPONENT

(75) Inventors: Shinichiro Sugiyama, Shiga-ken (JP); Kaori Takezawa, Shiga-ken (JP); Hiromi Miyoshi, Shiga-ken (JP); Masayuki Yoneda, Fukui-ken (JP)

(73) Assignee: Murata Manufacturing Co., Ltd. (JP)

( * ) Notice: Subject to any disclaimer, the term of this patent is extended or adjusted under 35 U.S.C. 154(b) by 0 days.

(21) Appl. No.: 12/581,654

(22) Filed: Oct. 19, 2009

(65) Prior Publication Data

US 2010/0109829 A1 May 6, 2010

(30) Foreign Application Priority Data

Oct. 30, 2008 (JP) ..... 2008-279116

(51) Int. Cl.
*H01F 5/00* (2006.01)

(52) U.S. Cl. ..... 336/200; 336/223; 336/232

(58) Field of Classification Search ..... 336/83, 336/200, 223, 232
See application file for complete search history.

(56) References Cited

U.S. PATENT DOCUMENTS 7,656,262 B2 * 2/2010 Muto ..... 336/200
7,817,007 B2 * 10/2010 Lee et al. ..... 336/200
2001/0017582 A1 * 8/2001 Sakata ..... 336/200
2001/0020885 A1 * 9/2001 Takeuchi et al. ..... 336/200
2003/0193386 A1 * 10/2003 Tseng et al. ..... 336/200

FOREIGN PATENT DOCUMENTS

JP 08-162327 A 6/1996
JP 11-097244 A 4/1999
JP 2000-182830 A 6/2000
JP 2004-311828 A 11/2004
JP 2008-053368 A 3/2008

OTHER PUBLICATIONS

Chinese Office Action; CN200910207966.1; Jun. 15, 2011.
Chinese Office Action; CN Application No. 200910207966.1; Jun. 15, 2011.
J. Tanaka; Japanese Office Action; JP Application No. 2008-279116; Aug. 2, 2010.

* cited by examiner

*Primary Examiner* — Anh Mai
(74) *Attorney, Agent, or Firm* — Studebaker & Brackett PC; Tim L. Brackett, Jr.

(57) ABSTRACT

A multilayer body is formed by laminating multiple insulating layers. External electrodes are provided on the opposed side surfaces of the multilayer body and extend in the z axis direction. Coil conductors are laminated together with the insulating layers and form a coil. Coil conductors other than coil conductors connected to the external electrodes are made up of pairs of adjacent coil conductors having an identical shape, and coil conductors forming each pair are connected in parallel to each other. None of the coil conductors connected to the external electrodes is connected in parallel to coil conductors with an identical shape.

1 Claim, 6 Drawing Sheets

PRIOR ART

ELECTRONIC COMPONENT

CROSS REFERENCE TO RELATED APPLICATIONS

The present application claims priority to Japanese Patent Application No. 2008-279116 filed Oct. 30, 2008, the entire contents of each of this application being incorporated herein by reference in their entirety.

BACKGROUND OF THE INVENTION

1. Field of the Invention

The present invention relates to an electronic component and, in particular, to an electronic component including a multilayer body including a coil.

2. Description of the Related Art

As an example of related-art electronic component, Japanese Unexamined Patent Application Publication No. 11-97244 describes a multilayer inductor. FIG. 6 thereof is an exploded perspective view of the multilayer inductor 100.

As shown in FIG. 6, the multilayer inductor 100 includes ceramic sheets 102*a* to 102*h* and coil conductors 104*a* to 104*d*. A multilayer body is formed by laminating the ceramic sheets 102*a* to 102*h*. External electrodes (not shown) are provided on the opposed side surfaces of the multilayer body.

The coil conductors 104*a* to 104*d* are electrodes, each taking the shape of a partially notched annular ring. The coil conductors 104*a* to 104*d* are connected to one another so that a coil is formed. The coil conductor 104*a* is connected in parallel to the coil conductor 104*b* with an identical shape. The coil conductor 104*c* is connected in parallel to the coil conductor 104*d* with an identical shape.

For this reason, the multilayer inductor 100 has a direct-current resistance value lower than that of a multilayer inductor not including the coil conductors 104*b* and 104*d*. As a result, the current capacity of the multilayer inductor 100 is increased.

However, as will be described below, the multilayer inductor 100 has a problem in that its resonant frequency is lowered. More specifically, the coil conductors 104*a* to 104*d* are opposed to external electrodes (not shown). Therefore, stray capacitances occur between the coil conductors 104*a* to 104*d* and the external electrodes. In particular, since the coil conductors 104*a* and 104*b* are connected in parallel and the coil conductors 104*c* and 104*d* are connected in parallel in the multilayer inductor 100, the sum of the areas of the opposed portions of the coil conductors 104*a* to 104*d* and external electrodes is larger than the sum of the areas of the opposed portions of the coil conductors 104*a* and 104*c* and external electrodes in a multilayer inductor not including the coil conductors 104*b* and 104*d*. As a result, the resonant frequency of the electronic component 100 is significantly reduced due to increases in stray capacitance.

SUMMARY OF THE INVENTION

Accordingly, it is an object of the present invention to provide an electronic component that controls undesirable reductions in resonant frequency and that provides an increase of large current capacity.

To achieve the object described above, according to preferred embodiments of the present invention, an electronic component according to a preferred embodiment of the present invention includes: a multilayer body including a plurality of laminated insulating layers; two external electrodes provided on opposed side surfaces of the multilayer body, the external electrodes extending in a direction of lamination of the multilayer body; and a plurality of coil conductors laminated together with the insulating layers, the coil conductors forming a coil. The coil conductors that are not connected to any of the external electrodes are each connected in parallel to the coil conductors with an identical shape. At least one of the coil conductors connected to the external electrodes is not connected in parallel to the coil conductors with an identical shape.

Specifically, among the coil conductors, coil conductors that are not connected to any of the external electrodes are made up of pairs of coil conductors having an identical shape, and coil conductors having an identical shape and forming a pair are connected to each other in parallel. Among the coil conductors, at least one of two coil conductors connected to one of the external electrodes is not connected to a coil conductor having an identical shape.

According to the above-described preferred embodiment of the present invention, a large current capacity is achieved and reductions in resonant frequency are prevented.

Other features, elements, characteristics and advantages of the present invention will become more apparent from the following detailed description of preferred embodiments of the present invention with reference to the attached drawings.

DESCRIPTION OF THE PREFERRED EMBODIMENTS

Figure 1:
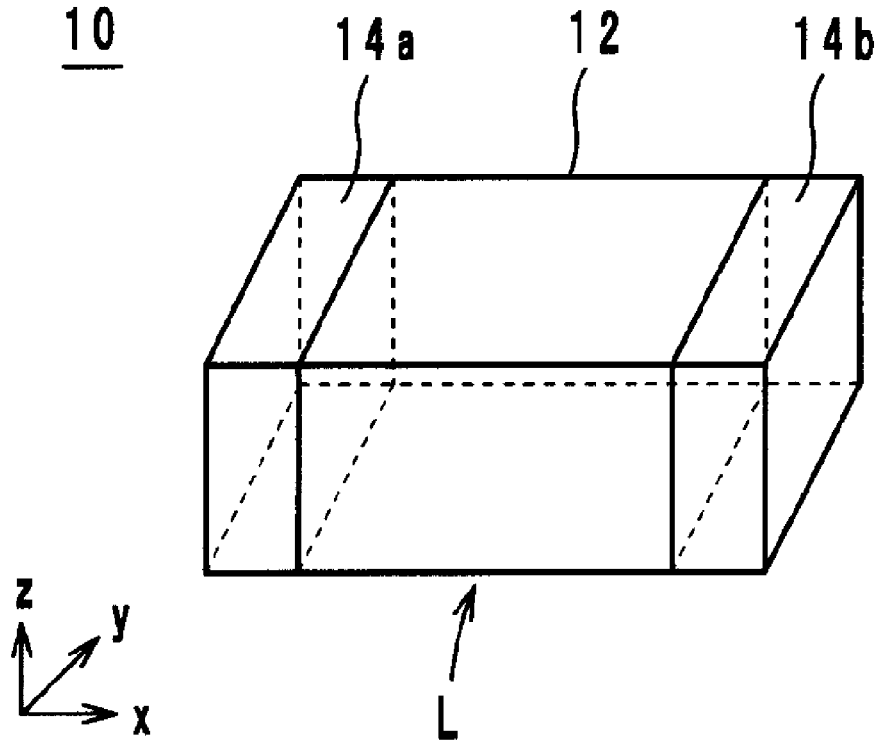
FIG. 1 is a perspective view of an electronic component according to an embodiment of the present invention.
Figure 2:
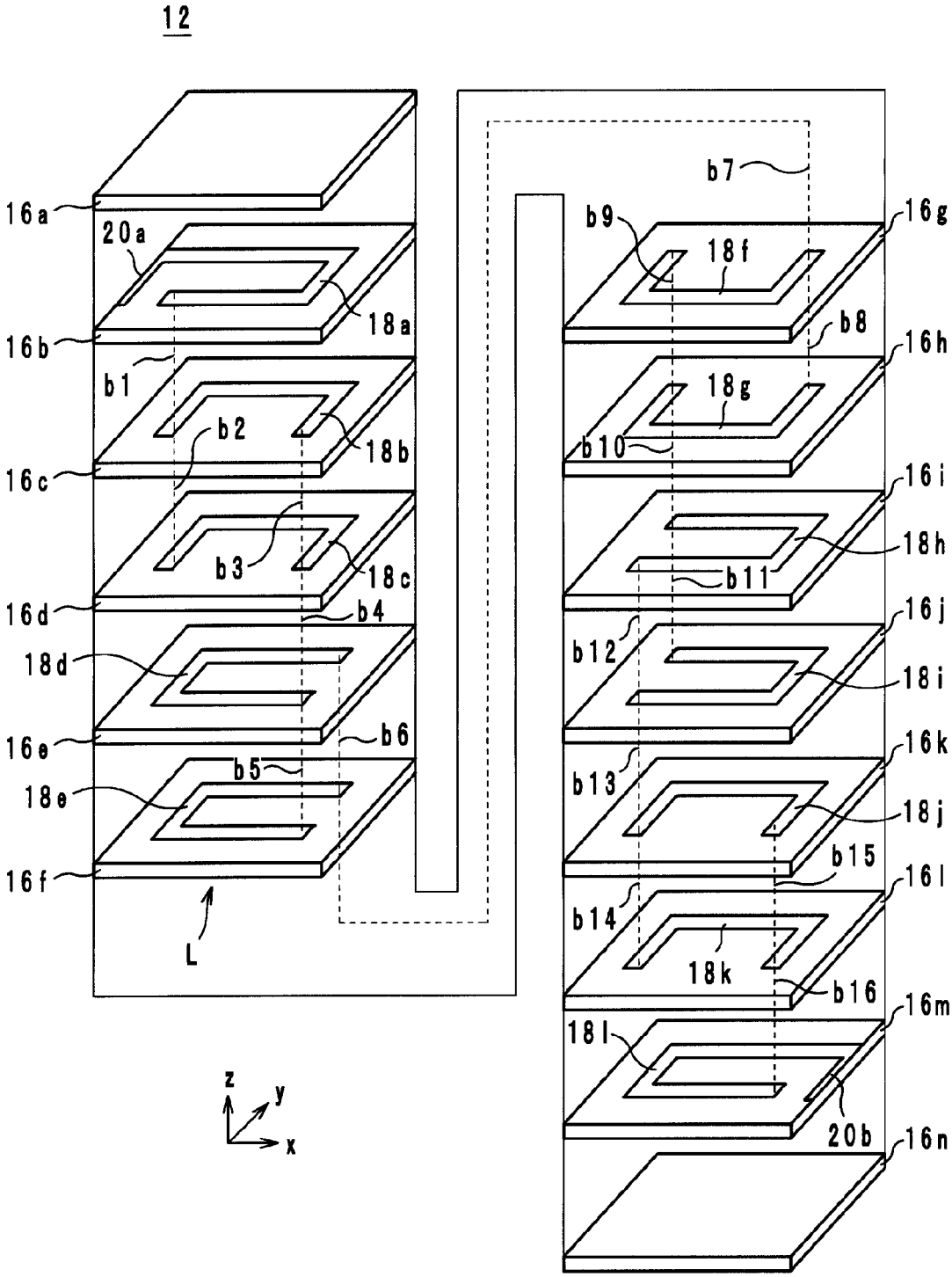
FIG. 2 is an exploded perspective view of a multilayer body of the electronic component according to the embodiment in FIG. 1.

The present invention will herein be described with reference to embodiments shown in FIGS. 1 to 5. Particularly, an electronic component 10 according to an embodiment of the present invention will be described with reference to the accompanying drawings. FIG. 1 is a perspective view of the electronic component 10 according to this embodiment. FIG. 2 is an exploded perspective view of a multilayer body 12 of the electronic component 10 according to this embodiment.

Hereafter, the lamination direction of the electronic component 10 will be defined as the z axis direction, the direction along the long sides of the electronic component 10 will be defined as the x axis direction, and the direction along the short sides thereof will be defined as the y axis direction. The x axis, y axis, and z axis are perpendicular to one another.

As shown in FIG. 1, the electronic component 10 includes the multilayer body 12 and external electrodes 14*a* and 14*b*. The multilayer body 12 substantially takes the shape of a rectangular parallelepiped and includes a coil L. The external electrodes 14*a* and 14*b* are provided on the opposed side surfaces of the multilayer body 12, are electrically connected to the coil L, and extend in the z axis direction. In this embodiment, the external electrodes 14*a* and 14*b* are provided such that the external electrodes cover the two side surfaces located at both ends in the X axis direction of the multilayer body 12.

As shown in FIG. 2, the multilayer body 12 is formed by laminating insulating layers 16*a* to 16*n* in the z axis direction. The insulating layers 16*a* to 16*n* are made of a material containing glass as the main ingredient, and each of the insulating layers takes the shape of a rectangle. Hereafter, when an individual insulating layer 16 is being specified, a letter will be provided after the reference numeral thereof. However, when the insulating layers 16 are being collectively referred to, the letters after the reference numerals will be omitted.

As shown in FIG. 2, the coil L is a helical coil that extends in the z axis direction, and includes coil conductors 18*a* to 18*l* and via-hole conductors b1 to b16. Hereafter, when an individual coil conductor 18 is being specified, an letter will be provided after the reference numeral thereof. However, when the coil conductors 18 are being collectively referred to, the letters after the reference numerals will be omitted.

As shown in FIG. 2, the coil conductors 18*a* to 18*l* are formed on the main faces of the insulating layer 16*b* to 16*m*, respectively, and are laminated together with the insulating layers 16*a* to 16*n*. Each coil conductor 18 is formed of a conductive material made of Ag and has a length of an about ¾ turn.

As further shown in FIG. 2, the coil conductor 18*a* provided at the edge in the positive direction of the z axis direction of the multilayer body 12 includes an extended portion 20*a*, and the coil conductor 18*l* provided at the edge in the negative direction of the z axis direction of the multilayer body 12 includes an extended portion 20*b*.

The coil conductor 18*a* and 18*l* are directly connected to the external electrodes 14*a* and 14*b*, respectively, via the extended portions 20*a* and 20*b*, respectively. The coil conductors 18*b* to 18*k*, which are not directly connected to any of the external electrodes 14*a* and 14*b*, are made up of pairs of coil conductors 18 adjacent to each other in the z axis direction.

Coil conductors 18 forming each pair having an identical shape and are connected to each other in parallel. Note that the coil conductors 18*a* and 18*l* directly connected to the external electrodes 14*a* and 14*b*, respectively, are formed on the insulating layer 16*a* and 16*m*, respectively, in one layer.

The coil conductors 18*a* and 18*l* are also connected to the external electrodes 14*a* and 14*b* in one layer. That is, there are no coil conductors 18 having an identical shape in adjacent positions, in the z axis direction, to the coil conductors 18*a* and 18*l* directly connected to the external electrodes 14*a* and 14*b*. Therefore, none of the coil conductors 18*a* and 18*l* is connected in parallel to any of the coil conductors 18*b* to 18*k* with an identical shape.

As shown in FIG. 2, the via-hole conductors b1 to b16 are formed such that the via-hole conductors pass through the insulating layers 16*b* to 16*l* in the z axis direction. When the insulating layers 16 are laminated, the via-hole conductors b1 to b16 serve as joints between the ends of the adjacent coil conductors 18.

More specifically, the via-hole conductor b1 connects an end, on which the extended portion 20*a* is not provided, among the ends of the coil conductor 18*a* and an end of the coil conductor 18*b*. The via-hole conductors b2 and b3 connect both ends of the coil conductor 18*b* and those of the coil conductor 18*c*. Thus, the coil conductors 18*b* and 18*c* are connected in parallel.

The via-hole conductor b4 connects an end, to which the via-hole conductor b3 is connected, among the ends of the coil conductor 18*c* and an end of the coil conductor 18*d*. The via-hole conductors b5 and b6 connect both ends of the coil conductor 18*d* and those of the coil conductor 18*e*. Thus, the coil conductors 18*d* and 18*e* are connected in parallel.

The via-hole conductor b7 connects an end, to which the via-hole conductor b6 is connected, among the ends of the coil conductor 18*e* and an end of the coil conductor 18*f*. The via-hole conductors b8 and b9 connect both ends of the coil conductor 18*f* and those of the coil conductor 18*g*. Thus, the coil conductors 18*f* and 18*g* are connected in parallel.

The via-hole conductor b10 connects an end, to which the via-hole conductor b9 is connected, among the ends of the coil conductor 18*g* and an end of the coil conductor 18*h*. The via-hole conductors b11 and b12 connect both ends of the coil conductor 18*h* and those of the coil conductor 18*i*. Thus, the coil conductors 18*h* and 18*i* are connected in parallel.

The via-hole conductor b13 connects an end, to which the via-hole conductor b12 is connected, among the ends of the coil conductor 18*i* and an end of the coil conductor 18*j*. The via-hole conductors b14 and b15 connect both ends of the coil conductor 18*j* and those of the coil conductor 18*k*. Thus, the coil conductors 18*j* and 18*k* are connected in parallel.

The via-hole conductor b16 connects an end, to which the via-hole conductor b15 is connected, among the ends of the coil conductor 18*k* and an end, on which the extended portion 20*b* is not provided, among the ends of the coil conductor 18*l*.

The insulating layers 16*a* to 16*n* configured as described above are laminated such that the insulating layers 16*a* to 16*n* are arranged in the presented order from top to bottom in the z axis direction. Thus, in the multilayer body 12, the coil L having a coil axis extending in the z axis direction and having a double helical structure is formed. However, the coil conductors 18*a* and 18*l* located at the edge in the positive direction or negative direction of the z axis direction of the coil L do not have a double helical structure.

Hereafter, a method for manufacturing the electronic component 10 will be described with reference to the drawings. Note that a method for manufacturing the electronic component 10 used when manufacturing multiple electronic components 10 simultaneously will be described.

First, a paste-shaped insulating material is applied onto film-shaped base materials (not shown in FIG. 2), and then the entire applied surfaces are exposed to ultraviolet rays. Thus, the insulating layers 16*m* and 16*n* are formed. Next, a paste-shaped conductive material is applied onto the insulating layer 16*m* and then subjected to exposure and development. Thus, the coil conductor 18*l* is formed.

Next, the paste-shaped insulating material is applied onto the insulating layer 16*m* and coil conductor 18*l*. Then, by performing exposure and development, the insulating layer 16*l* having a via hole in the position of the via-hole conductor b16 is formed. Next, the paste-shaped conductive material is applied onto the insulating layer 16*l* and then subjected to exposure and development. Thus, the coil conductor 18*k* and via-hole conductor b16 are formed.

Subsequently, by repeating the same steps as the steps of forming the insulating layer 16*l*, coil conductor 18*k*, and via-hole conductor b16, the insulating layers 16*c* to 16*k*, coil conductors 18*b* to 18*j*, and via-hole conductors b2 to b15 are formed.

After forming the coil conductor 18*b* and via-hole conductor b2, the paste-shaped insulating material is applied onto the insulating layer 16*c* and coil conductor 18*b*. Then, by performing exposure and development, the insulating layer 16*b* having a via hole in the position of the via-hole conductor b1 is formed. Next, the paste-shaped conductive material is applied onto the insulating layer 16*b* and then subjected to exposure and development. Thus, the coil conductor 18*a* and via-hole conductor b1 are formed.

Next, the paste-shaped insulating material is applied onto the insulating layer 16*b* and coil conductor 18*a* and then the entire applied surface is exposed to ultraviolet rays. Thus, the insulating layer 16*a* is formed. In this way, a multilayer body 12 is manufactured.

Next, the multilayer body is cut into individual multilayer bodies 12 using a straw cutter. Subsequently, the multilayer bodies 12 are fired at a predetermined temperature for a predetermined time.

Next, each multilayer body 12 is polished using a barrel so as to round off the edges thereof or remove burrs, and the extended portions 20*a* and 20*b* are exposed from each multilayer body 12.

Next, the side surfaces of each multilayer body 12 are dipped into a silver paste and the silver paste is baked. Thus, silver electrodes are formed. Finally, the silver electrodes are plated with Ni, Cu, Zn, or the like. Thus, the external electrodes 14*a* and 14*b* are formed. By performing the above-mentioned steps, the electronic component electronic components 10 are completed.

As will be described below, the electronic component 10 makes it possible to avoid reductions in resonant frequency while providing a large current capacity. More specifically, the coil conductors 18*b* to 18*k* are made up of pairs of coil conductors 18 adjacent to each other in the z axis direction. Coil conductors 18 forming each pair take an identical shape and are connected to each other in parallel. Thus, the direct-current resistance value of the coil L is reduced. As a result, the electronic component 10 can have a large current capacity.

However, as described above, the electronic component 10 has a double helical structure. For this reason, the coil conductors 18*b* to 18*k* are made up of pairs of coil conductors 18 adjacent to each other in the z axis direction, and coil conductors 18 forming each pair take an identical shape. Therefore, the sum of the areas of the opposed portions of the coil conductor 18*a* and external electrodes 14 in the electronic component 10 is larger than that in a typical electronic component having a single helical structure. For this reason, none of the coil conductors 18*a* and 18*l* of the electronic component 10 is connected to a coil conductor 18 having an identical shape.

More specifically, the potential difference between the coil conductor 18*a* among the coil conductors 18*a* to 18*l* and the external electrode 14*b* is the largest potential difference. Therefore, the stray capacitance caused between the coil conductor 18*a* and external electrode 14*b* has a larger effect on the resonant frequency than those caused between the coil conductors 18*b* to 18*l* and external electrode 14*b*.

Likewise, the potential difference between the coil conductor 18*l* among the coil conductors 18*a* to 18*l* and the external electrode 14*a* is the largest potential difference. Therefore, the stray capacitance caused between the coil conductor 18*l* and external electrode 14*a* has a larger effect on the resonant frequency than those caused between the coil conductors 18*a* to 18*k* and external electrode 14*a*. For this reason, none of the coil conductors 18*a* and 18*l* of the electronic component 10 is connected to a coil conductor 18 having an identical shape. Thus, there are no coil conductors 18 having a potential identical to that of the coil conductor 18*a* or coil conductor 18*l*. As a result, the electronic component 10 effectively avoids reductions in resonant frequency due to increases in stray capacitance.

Figure 3:
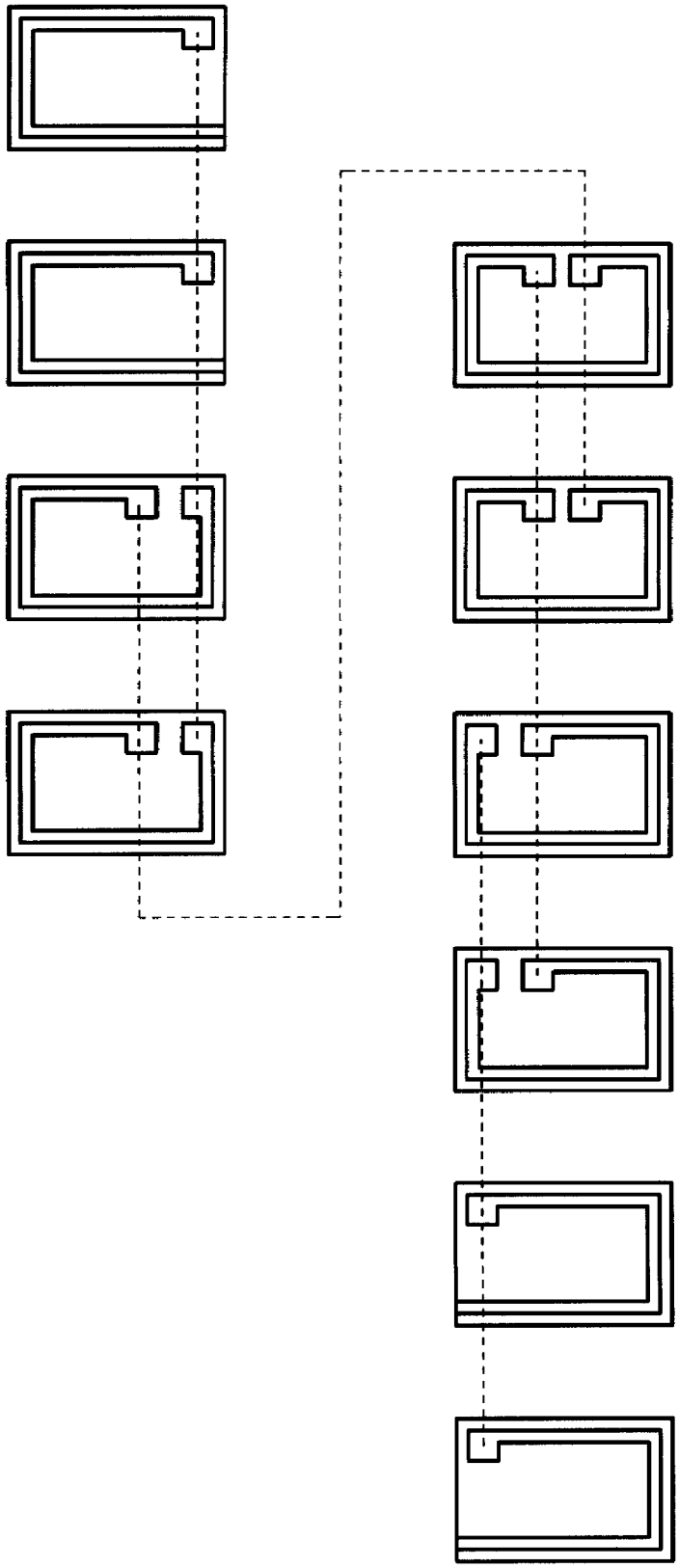
FIG. 3 is an exploded view of a first model.
Figure 4:
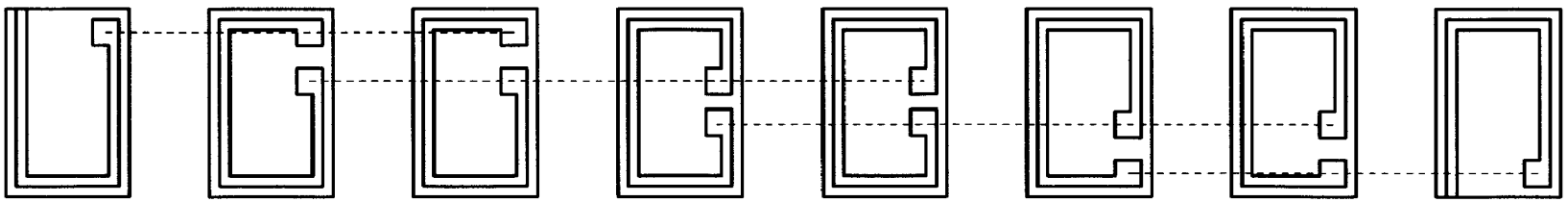
FIG. 4 is an exploded view of a second model.

In order to clarify the advantages of the electronic component 10, the inventors performed a computer simulation to be described below. Specifically, an electronic component (first model) having a structure shown in FIG. 3 and an electronic component (second model) having a structure shown in FIG. 4 were manufactured. FIGS. 3 and 4 are exploded views of the first and second models, respectively.

The first model corresponds to a related-art electronic component and has a structure where the coil conductors thereof are made up of pairs of coil conductors, and coil conductors forming each pair have an identical shape and are connected to each other in parallel.

The second model corresponds to the electronic component 10 and has a structure where the coil conductors other than the coil conductors connected to the external electrodes are made up of pairs of coil conductors, and coil conductors forming each pair have an identical shape and are connected to each other in parallel. The sizes of the first model and second model are both about 0.6 mm×0.3 mm×0.3 mm, and the coil conductors thereof are silver electrodes having a thickness of about 9 μm.

Figure 5:
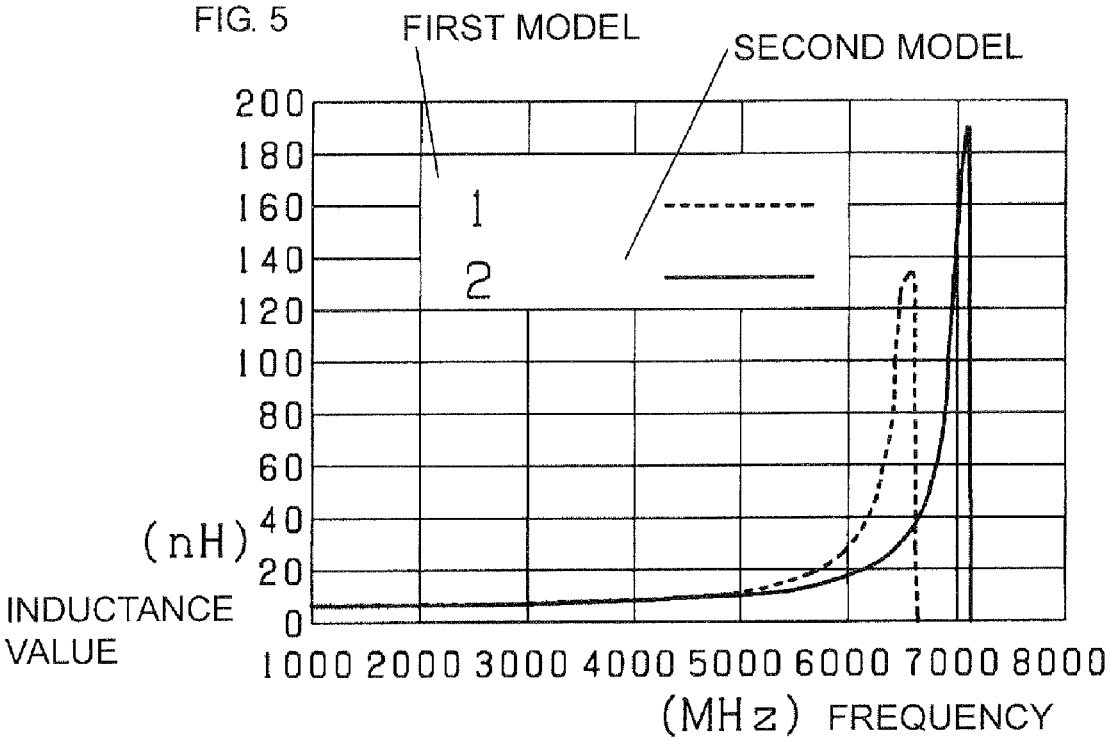
FIG. 5 is a graph showing the result of a simulation.
Figure 6:
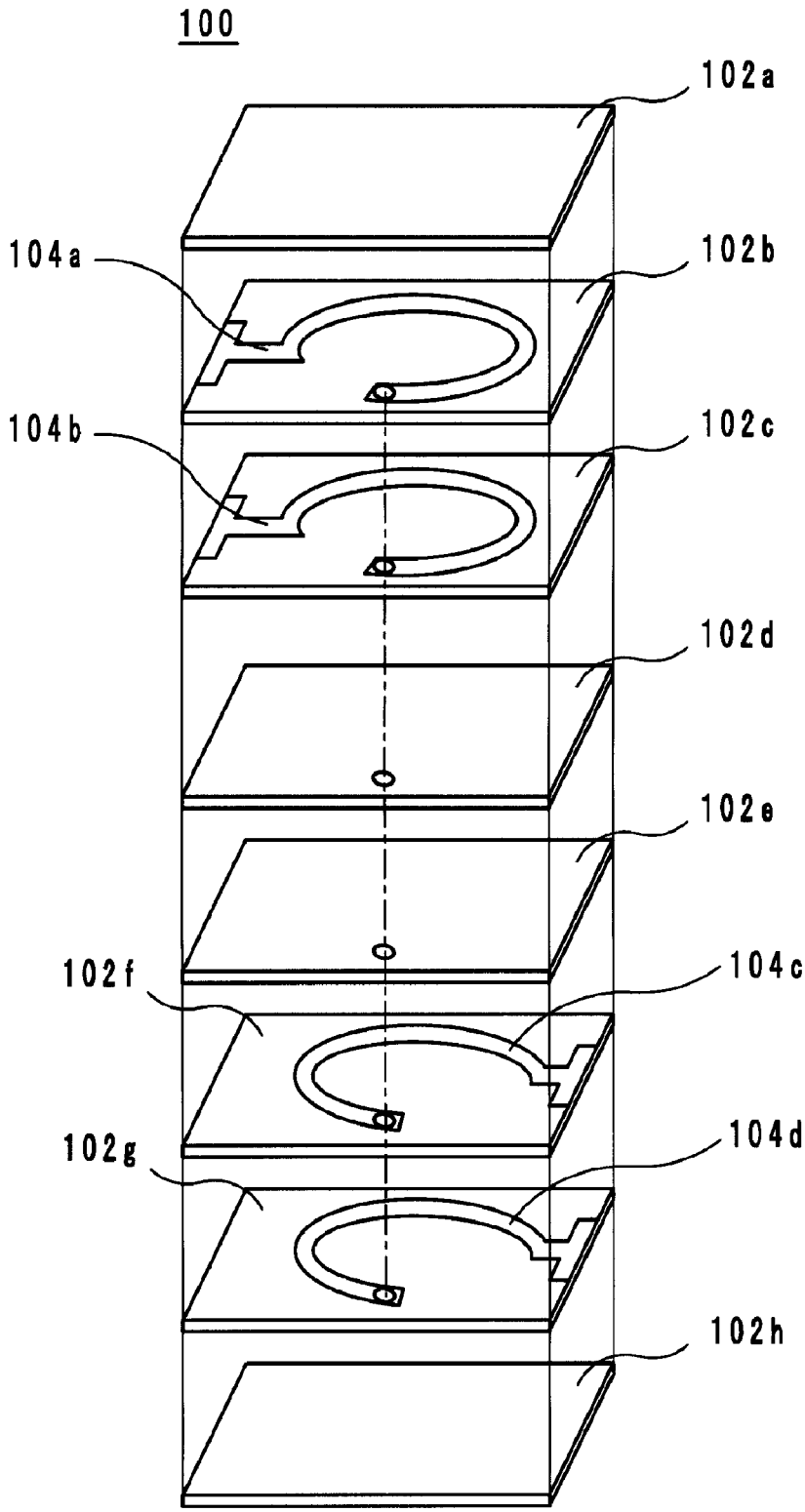
FIG. 6 is an exploded perspective view of a multilayer inductor described in Japanese Unexamined Patent Application Publication No. 11-97244.

In a computer simulation, the inductance values of the first model and second model were calculated while changing the frequency of signals inputted into the first model and second model. FIG. 5 is a graph showing the result of the simulation. The vertical axis represents the inductance value, and the lateral axis represents the frequency.

As shown in FIG. 5, for the first model, the inductance value became zero when a signal having a frequency of about 6.6 GHz was inputted thereinto. This indicates that the resonant frequency of the first model is about 6.6 GHz.

On the other hand, for the second model, the inductance value became zero when a signal having a frequency of about 7.2 GHz was inputted thereinto. This indicates that the resonant frequency of the second model is about 7.2 GHz. Thus, it is understood that the second model has a resonant frequency higher than that of the first model. Therefore, from the simulation, it is understood that the electronic component 10 is allowed to effectively restrain reductions in resonant frequency due to increases in stray capacitance.

Changes may be made to the electronic component 10 according to the above-mentioned embodiment without departing from the spirit and scope of the present invention. For example, the number of turns of each coil conductor 18 or the number of turns of the coil L is not limited to that shown in FIG. 2.

While none of the coil conductors 18*a* and 18*l* in the multilayer body 12 of the electronic component 10 shown in FIG. 2 is connected to a coil conductor 18 having an identical shape, it is sufficient if at least one of the coil conductors 18*a* and 18*l* is not connected to a coil conductor 18*a* having an identical shape.

While preferred embodiments of the invention have been described above, it is to be understood that variations and modifications will be apparent to those skilled in the art without departing from the scope and spirit of the invention. The scope of the invention, therefore, is to be determined solely by the following claims.

What is claimed is:

1. An electronic component comprising:

a multilayer body including a plurality of laminated insulating layers;

two external electrodes provided on opposed side surfaces of the multilayer body, the external electrodes extending in a direction of lamination of the multilayer body; and a plurality of coil conductors laminated together with the insulating layers, the coil conductors forming a coil, wherein the coil conductors that are not connected to the external electrodes are each connected in parallel to coil conductors having an identical shape, and at least one of the coil conductors connected to the external electrodes is not connected in parallel to the coil conductors having an identical shape.

* * * * *